US011453039B2

(12) United States Patent
Kneer

(10) Patent No.: US 11,453,039 B2
(45) Date of Patent: Sep. 27, 2022

(54) STAMPING PRESS AND METHOD FOR STAMPING A ROUND BLANK

(71) Applicant: SCHULER PRESSEN GMBH, Goeppingen (DE)

(72) Inventor: Simon Kneer, Eislingen (DE)

(73) Assignee: Schuler Pressen GmbH, Goeppingen (DE)

( * ) Notice: Subject to any disclaimer, the term of this patent is extended or adjusted under 35 U.S.C. 154(b) by 0 days.

(21) Appl. No.: 16/848,950

(22) Filed: Apr. 15, 2020

(65) Prior Publication Data

US 2020/0238356 A1 Jul. 30, 2020

Related U.S. Application Data

(63) Continuation-in-part of application No. PCT/EP2018/076815, filed on Oct. 2, 2018.

(30) Foreign Application Priority Data

Oct. 17, 2017 (DE) ..... 10 2017 124 148.5

(51) Int. Cl.
*B21D 22/02* (2006.01)

(52) U.S. Cl.
CPC ..... *B21D 22/02* (2013.01)

(58) Field of Classification Search
CPC ..... B21D 22/02; B21D 45/00; B21D 45/003; B21D 45/02; B21D 45/04; B21D 22/06; B30B 1/02; B30B 1/26; B21J 13/14
USPC ..... 72/344, 345, 427
See application file for complete search history.

(56) References Cited

U.S. PATENT DOCUMENTS 1,415,459 A 5/1922 Limoni
3,034,641 A 5/1962 Kochan
(Continued)

FOREIGN PATENT DOCUMENTS

CN 106 625 123 A 5/2017
DE 32 30 958 A1 2/1984
(Continued)

OTHER PUBLICATIONS

The International Search Report for the corresponding international application No. PCT/EP2018/076815, dated Jan. 8, 2019, in the German language (3 pages).
(Continued)

*Primary Examiner* — Edward T Tolan
(74) *Attorney, Agent, or Firm* — Ronald S. Lombard

(57) ABSTRACT

A stamping press for stamping a round blank. A ram movable in a stroke direction and in an opposite return stroke direction carries a first stamping tool. A second stamping tool and a stamping ring are supported on a press framework. The stamping tools and a stamping opening formed by the stamping ring are aligned along a working axis. An ejector device serves to eject a stamped round blank from the ring opening. It comprises an ejector pin supported on an actuating device that is movably coupled with the ram. During a return stroke of the ram the ejector pin can apply a force on the second stamping tool in order to press the round blank out of the stamping ring. In a ram movement in the stroke direction the actuating device departs from the second stamping tool and no ejector pin force is applied on the second stamping tool.

16 Claims, 15 Drawing Sheets

(56) References Cited

U.S. PATENT DOCUMENTS

| | | | | |
|---|---|---|---|---|
| 3,053,122 | A * | 9/1962 | Martindell | B44B 5/024 72/345 |
| 3,448,604 | A | 6/1969 | Finsterwalder | |
| 3,452,577 | A * | 7/1969 | Schmeltzer | B21D 45/00 72/345 |
| 3,910,096 | A | 10/1975 | Debus | |
| 4,044,592 | A | 8/1977 | Carrieri et al. | |
| 8,770,075 | B2 * | 7/2014 | Walther | B21D 28/16 83/109 |
| 8,955,364 | B2 * | 2/2015 | Breen | B23P 15/24 72/344 |

FOREIGN PATENT DOCUMENTS

| | | |
|---|---|---|
| DE | 197 01 282 A1 | 7/1998 |
| DE | 101 50 101 A1 | 5/2002 |
| EP | 0 151 204 A1 | 8/1985 |
| EP | 0 101 590 B1 | 7/1987 |
| EP | 0 648 618 A1 | 4/1995 |
| EP | 0 101 590 A2 | 2/2004 |
| GB | 1 476 757 A | 6/1977 |

OTHER PUBLICATIONS

The English translation of the International Search Report for the corresponding international application No. PCT/EP2018/076815 (2 pages).

An English translation of the substantive portion of the Office Action of the Chinese Patent Office, dated May 8, 2021, for a counterpart Chinese Patent Application No. 201880067603X.

The Office Action dated May 8, 2021 of the Chinese Patent Office in the Chinese language for the counterpart Chinese Patent Application No. 201880067603X.

* cited by examiner

STAMPING PRESS AND METHOD FOR STAMPING A ROUND BLANK

CROSS-REFERENCE TO RELATED APPLICATION

This is a continuation-in-part application of pending international patent application PCT/EP2018/076815 filed Oct. 2, 2018 and claiming the priority of German Patent Application No. 10 2017 124 148.5 filed Oct. 17, 2017. The said international patent application PCT/EP2018/076815 and said German Patent Application No. 10 2017 124 148.5 are both incorportated herein by reference in their entireties as though fully set forth.

BACKGROUND OF THE INVENTION

The invention relates to a stamping press as well as a method for stamping a round blank using the stamping press.

The stamping press comprises a ram that can be driven by means of a ram drive. A first stamping tool is seated at the ram. A second stamping tool cooperates with the first stamping tool. During the stamping process a round blank to be stamped is located within a stamping ring that limits the axial extension of the round blank during stamping and thus defines the radius or the circumference of the round blank. Subsequently the stamped round blank must be ejected from the stamping ring. For this an ejector pin is provided that engages the second stamping tool in order to eject the stamped round blank from the stamping ring.

Such a stamping press is known from EP 0 151 204 A1. A lever transmission is provided for driving the ejector pin. A pressure rod is connected with the ram at one end and is hinged to a lever with another end. The lever is pivotably supported at the press framework. In the center of the lever the ejector pin is supported. Due to the movement of the pressure rod together with the ram, the lever and thus the ejector pin pivot.

A disadvantage of such configurations of coupling the ram with the ejector pin is that the stroke of the ejector pin is determined by the lever transmission and the stroke of the ram. In doing so, it is difficult to adjust the stroke movement of the ejector pin that on one hand a reliable ejection of the stamped round blank is guaranteed and on the other hand a faultless feeding of the round blank into the stamping ring is allowed in order to stamp the round blank.

Thus, it can be considered as object of the present invention to provide an improved stamping press or an improved method for stamping a round blank that avoids the disadvantages mentioned above.

SUMMARY OF THE INVENTION

This object is solved by a stamping press and a method in accordance with the claims. The invention refers to a stamping press for stamping a round blank 14. A ram 11 movable in a stroke direction H and opposite to the stroke direction H in a return stroke direction R carries a first stamping tool 13. A second stamping tool 15 is supported on a press framework 16. In addition, a stamping ring 22 is arranged on the press framework 16. The stamping tools 13, 15 and a stamping opening 23 formed by the stamping ring 22 are arranged aligned along a working axis A. An ejector device 30 serves to eject a stamped round blank 14 from the ring opening 23 of the stamping ring 22. It comprises an ejector pin 31 that is supported on an actuating device 32. The actuating device 32 is movably coupled with ram 11. During a return stroke of ram 11 in return stroke direction R the ejector pin 31 can be supported at the actuating device 32 and apply a force on the second stamping tool 15 in return stroke direction R in order to press the round blank 14 out of the stamping ring 22. During a movement of the ram 11 in stroke direction H the actuating device 32 departs from second stamping tool 15 such that the ejector pin 31 does not apply a force in return stroke direction R on the second stamping tool 15 and the second stamping tool 15 can take the stamping position P.

According to the invention, the stamping press comprises a ram that is moveable by means of a ram drive in a stroke direction, as well as counter the stroke direction in a return stroke direction. In doing so, the ram is guided along a working axis in a linear manner. A first stamping tool is arranged on the ram. A second stamping tool is arranged on a press framework. The two stamping tools cooperate for stamping a round blank. In addition, a stamping ring is present that is configured to surround the round blank during stamping. The stamping ring is arranged at the press framework. The extension of the round blank radial or orthogonal to the working axis during stamping is limited due to the stamping ring. The stamping ring predefines the circumference of the stamped round blank so-to-speak. The inner opening of the stamping ring must not be circular, but can also have arbitrary other contours, e.g. polygonal contours, if polygonal coins, medals or other round blanks shall be stamped.

The stamping press also comprises an ejector device having an ejector pin. The ejector pin is configured to engage the second stamping tool for ejecting a stamped round blank from the stamping ring in the return stroke direction, if the completely stamped round blank shall be pressed or ejected out of the stamping ring.

The stamping press comprises a connection device that is configured for connection or coupling of the ejector pin with the ram. The connection device comprises an actuating device carrying or supporting the ejector pin and at least one connection rod. The connection rod connects the ram and the actuating device and couples them with each other preferably without gear transmission ratio such that the stroke movement of the ram is identical with the stroke movement of the actuating device. In a preferred embodiment only one single connection rod is present. The connection rod and the actuating device are configured such that the ejector pin and the second stamping tool are not subject to a force in return stroke direction until the second stamping tool has reached a stamping position, if the ram is moved in stroke direction for stamping the round blank by means of the ram drive. Preferably the length of the at least one connection rod in stroke or return stroke direction can be changed in order to compensate changes that occur during operation, such as wear.

Due to this configuration, the second stamping tool can be moved in the stamping position without being impeded to do so by the ejector pin. In doing so, it can be guaranteed that the stamping process during which the first stamping tool presses the round blank against the second stamping tool is only carried out, if the second stamping tool has reached the stamping position and opposes a respective counter holding force to the first stamping tool. If a round blank that is to be stamped abuts at the second stamping tool being in the stamping position, the round blank is surrounded by the stamping ring in circumferential direction. The round blank can be reliably inserted into the stamping ring.

After the stamping process, during a return stroke movement of the ram in return stroke direction, the ejector pin can move the second stamping tool in return stroke direction and in doing so, can eject the stamped round blank out of the stamping ring.

It is advantageous, if a coupling device is arranged between the actuating device and the ejector pin. The coupling device can be switched between a coupling position and a decoupling position. The coupling device is configured to establish a coupling between the actuating device and the ejector pin for the movement in return stroke direction in the coupling position and to decouple the movement of the actuating device in return stroke direction from the ejector pin in the decoupling position such that the ejector pin does not commonly move with the actuating device in return stroke direction. Thus, the ejection of the round blank from the stamping ring during a return stroke of the ram in return stroke direction can be avoided by means of the coupling device. The second stamping tool remains in its stamping position and the round blank remains in the stamping ring. In doing so, the first stamping tool can carry out multiple stamping strokes onto the same round blank before the round blank is finally ejected from the stamping ring.

It is preferred, if the coupling device comprises a first coupling part coupled with the actuating device, a second coupling part coupled with the ejector pin and a coupling drive. By means of the coupling drive, at least one of the two coupling parts can be moved in order to switch the coupling device between the coupling position and the decoupling position. Preferably one of the two coupling parts can be moved linearly by means of the coupling device, e.g. transverse or orthogonal to the stroke direction or the return stroke direction. The coupling drive can comprise an electric motor. The coupling drive can comprise a linear motor or a pneumatic cylinder or a hydraulic cylinder. One of the coupling parts that is connected with the coupling drive can be configured as a comb slide, whereas the other coupling part forms a counter comb. It is further preferred, if only one of the two coupling parts is movable by means of the coupling drive and that the respective other coupling part is arranged movably transverse to the stroke direction or the return stroke direction.

Preferably a gap or play exists between the two coupling parts within a predefined movement range of the rain, wherein the second stamping tool is located in the stamping position in this predefined movement range of the rain.

It is also advantageous, if the actuating device comprises a lever arrangement. Preferably the lever arrangement has a first lever and a second lever. In one embodiment only two levers are present, namely the first lever and the second lever. The first lever and the second lever are connected with each other in a hinged manner at a hinge location. Preferably the first lever is supported at a press framework of the stamping press in a hinged manner. This first support location can be located at the side of the first lever opposite the hinge location.

In a preferred embodiment the ejector is coupled with the first lever at a first coupling location. The first coupling location is arranged with a distance to the hinge location in a transverse direction. The transverse direction is orientated orthogonal to the stroke direction or to the return stroke direction.

It is also advantageous, if the at least one connection rod and preferably the only one connection rod is coupled with the second lever at a second coupling location. The second coupling location has a distance to the hinge location in transverse direction.

In one embodiment the distance of the hinge location from the first coupling location is equal to the distance of the hinge location from the second coupling location.

In one embodiment the second stamping tool abuts at a stop of the press frame in its stamping position such that a movement of the second stamping tool in stroke direction is prevented by the stop. It is also advantageous, if the second stamping tool is urged in the stamping position by means of a biasing device. Without a force applied from the ejector pin, the second stamping tool maintains the stamping position.

An overload safety device can be arranged at the actuating device, wherein the overload safety device operates particularly fluidically and preferably pneumatically. The overload safety device can also operate without fluids only mechanically and can be configured with a linear mechanical overload actuating device and the ejector pin. In doing so, it is avoided that two large forces are transmitted from the ejector pin onto the second stamping tool in case of a clamping of the stamped round blank in the stamping ring. A fluidically or hydraulically operating overload safety device can guarantee a fast tripping.

The overload safety device can be connected with the second lever of the lever arrangement.

In one embodiment the overload safety device comprises a fluid chamber that is filled with a fluid and particularly air or another gas. The fluid chamber can be present in a bellows (air bellows or gas bellows) for example. Preferably the fluid chamber is filled with a predefined fluid pressure. If air or another gas is present in the fluid chamber, it is achieved that the force that can be transmissioned between the actuating device and the ejector pin is limited due to the compressibility of the air or the other gas.

Preferably the overload safety device and particularly the fluid chamber or the air or gas bellows is coupled with the second lever at a second support location. The support location between the overload safety device and the second lever is preferably located with distance to the hinge location in transverse direction. In a preferred embodiment the first and the second support location respectively have the same distance from the hinge location. The lever length of the second lever between the second support location and the hinge location and the lever length of the first lever between the first support location and the hinge location can be equal. As long as the force acting on the ejector is below a threshold, the overload safety device supports the second lever with regard to the press framework substantially in a rigid manner. If a threshold of the force is exceeded, the overload safety device budges and the second lever can move at the support location of the overload safety device and the second lever. In doing so, an excessive increase of the force on the ejector is avoided.

The overload safety device preferably operating with a gas (e.g. air) limits a force acting on the ejector, due to the compressibility of the gas. The fluid chamber can be closed with reference to the environment without overpressure or safety valve or can be connected with a feedback-controlled gas pressure source. In doing so, it can be ensured that a predefined fluid pressure applies in the fluid chamber, if the overload safety device is not activated.

Alternatively to the embodiment described above, the overload safety device can use a liquid as fluid in another embodiment, e.g. hydraulic oil and preferably the transmission oil of the stamping press. In this embodiment the fluid chamber can be limited at one side by a movable piston. The ejector pin can be supported indirectly at the movable piston. The fluid chamber can be fluidically connected with a safety valve. The safety valve is configured to limit the fluid pressure in the fluid chamber. If the fluid pressure exceeds a threshold, the safety valve is opened and the fluid can flow out of the fluid chamber. Thus, the piston is no longer able to be supported on the fluid and moves relative to the cylinder, in which the fluid chamber is formed. The relative movement that the piston carries out in case of a pressure relief in the fluid chamber, is preferably at least as large as the stroke path of the ram or the carrier. Thus, no ejection force can be transmitted to the second stamping tool via the ejector pin.

It is advantageous, if a first spring device is present. Preferably the first spring device can urge the ejector pin away from the second stamping tool.

BRIEF DESCRIPTION OF THE DRAWINGS

Preferred embodiments of the stamping press and the method yield from the dependent claims. In the following preferred embodiments of the invention are explained with reference to the attached drawings. The drawings show:

DETAILED DESCRIPTION OF THE INVENTION

Figure 3:
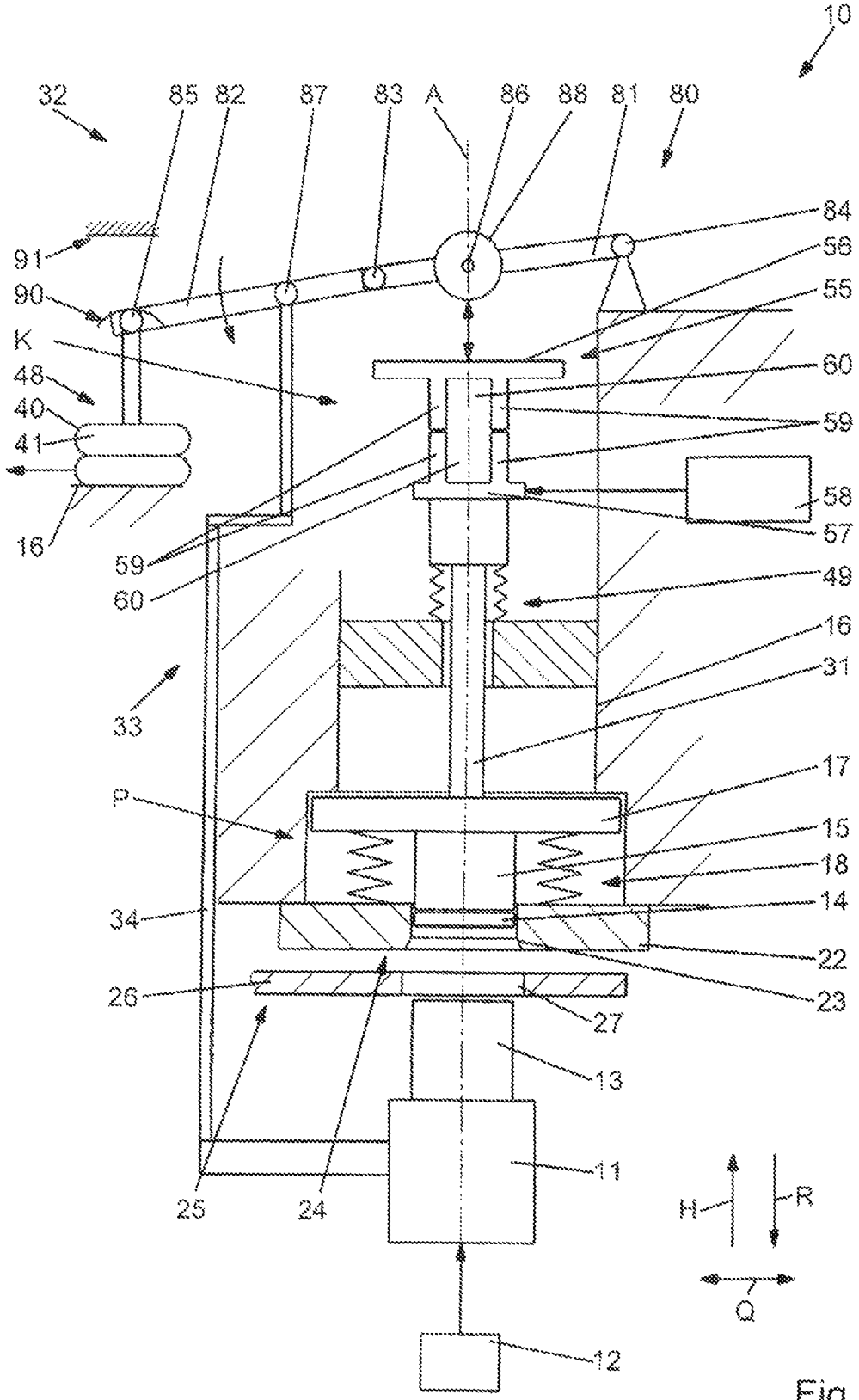
Figure 4:
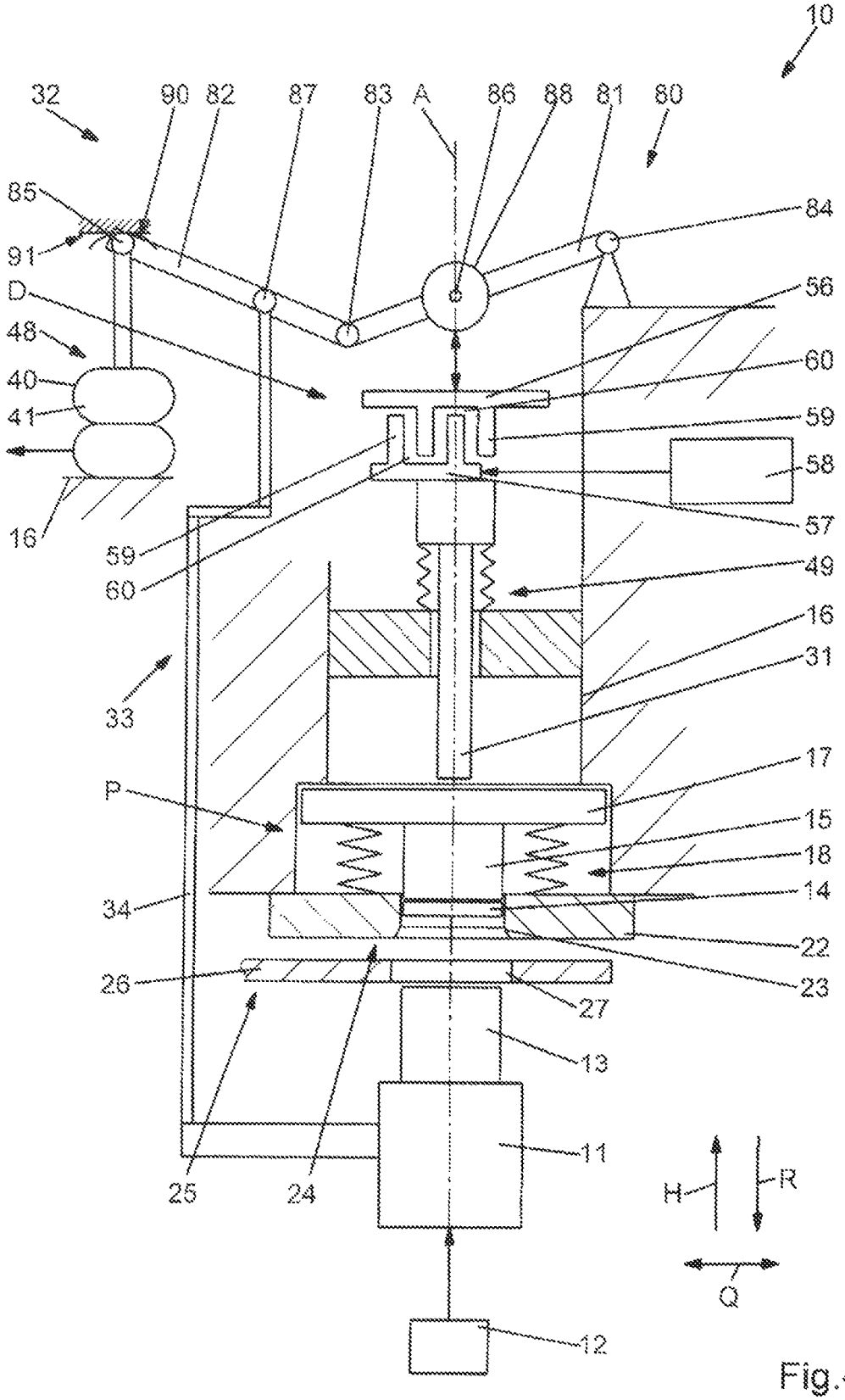
Figure 5:
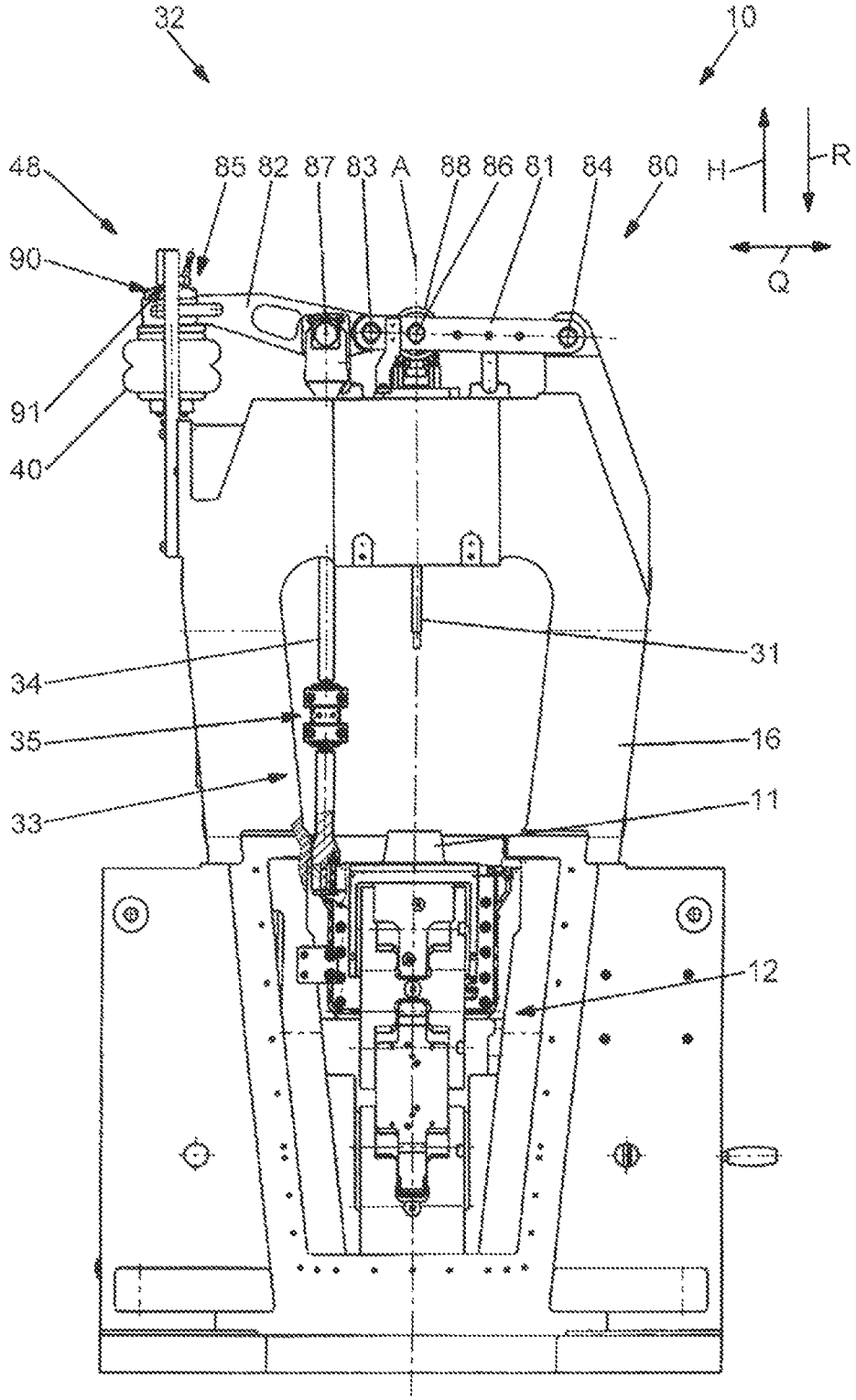

An embodiment of a stamping press 10 according to the invention is highly schematically illustrated in the block-diagram-like illustrations of FIGS. 1-4, in perspective illustration in FIG. 5 and in partial illustrations in FIGS. 6-9. The stamping press 10 comprises a ram 11 that is linearly movable along a working axis A by means of a ram drive 12. The ram 11 can be moved parallel to the working axis A in a stroke direction H as well as opposite to the stroke direction H in a return stroke direction R.

A first stamping tool 13 is arranged on the ram 11. The first stamping tool 13 can also be denoted as stamping punch. The first stamping tool 13 cooperates with a second stamping tool 15 for stamping of a round blank 14. A round blank can be a coin, a medal or the like. The round blank 14 can have an arbitrary outer geometry and can be, for example, circular or polygonal. The round blank 14 can be formed from multiple round blank parts, e.g. a round blank core and at least one round blank ring surrounding the round blank core.

Figure 1:
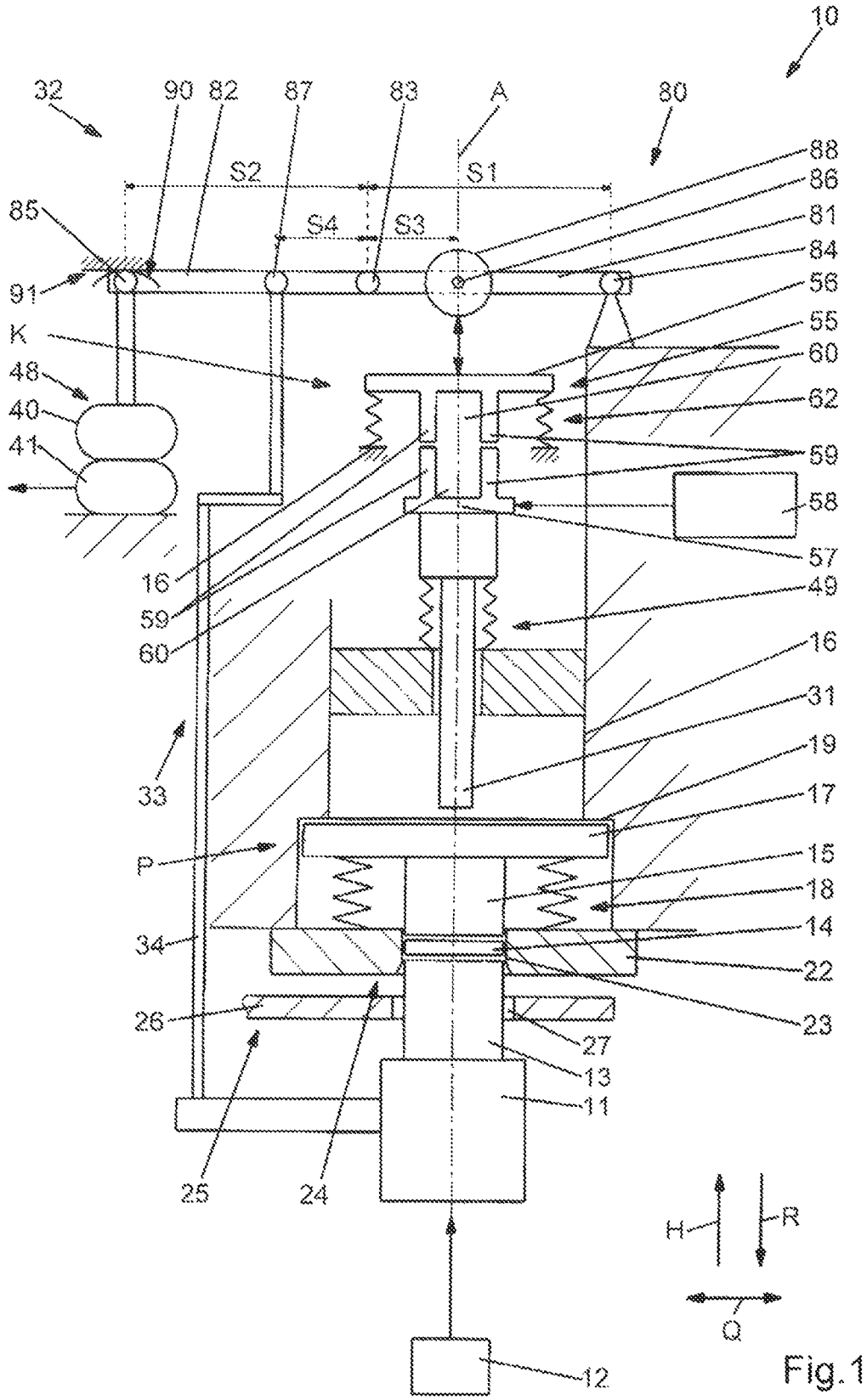
FIGS. 1-4 highly schematic block-diagram-like illustration of an embodiment of the stamping press with an ejector device respectively in a partly cut side view, FIG. 5 a side view of an embodiment of a stamping press, FIG. 6 a cut partial illustration of the ejector device of the stamping press of FIG. 5, FIG. 7 a cut illustration of an embodiment of a coupling device of the stamping press of FIGS. 5 and 6, FIGS. 8 and 9 a schematic block-diagram-like illustration of the embodiment of a coupling device respectively, FIGS. 10-13 a highly schematic block-diagram-like illustration of another embodiment of a stamping press with an ejector device in a partly cut side view respectively, FIG. 14 a perspective partial illustration of another embodiment of an ejector device, FIG. 15 a cut partial illustration of the ejector device of FIG. 14 and FIG. 16 a cut partial illustration of the ejector device according to FIGS. 14 and 15, wherein particularly a coupling device of the ejector device is shown.
Figure 2:
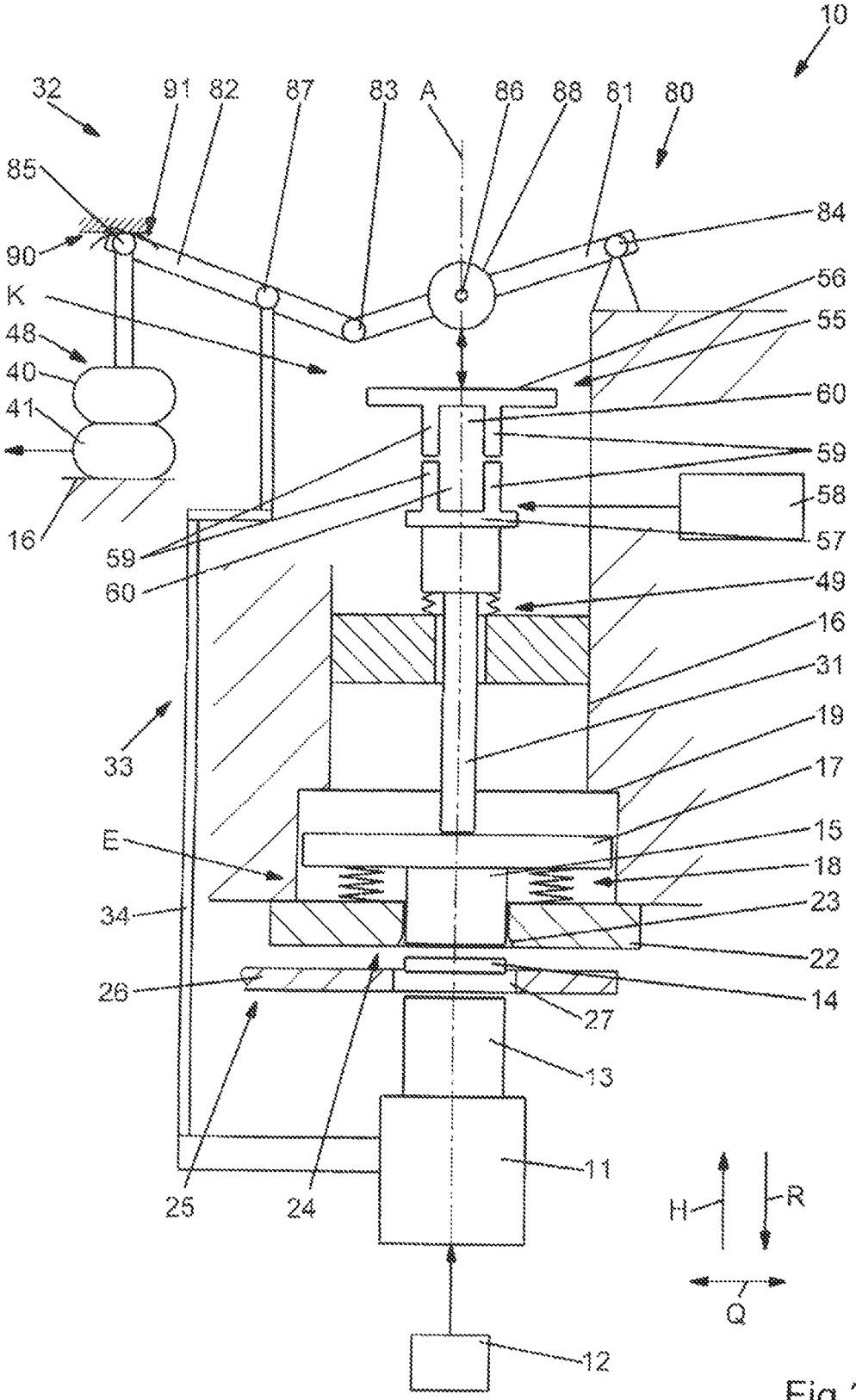

The second stamping tool 15 is supported on a press framework that is illustrated only highly schematically in FIGS. 1-4. The stamping tool 15 can be arranged on a tool carrier 17 that is supported at the press framework 16. The tool carrier 17 can be linearly moved commonly with the second stamping tool 15 between a stamping position P (FIG. 1) and an ejecting position E (FIG. 2). At the press framework 16 a biasing device 18 is arranged that biases or urges the second stamping tool 15 in the stamping position P. According to the example, the second stamping tool 15 is indirectly supported via the tool carrier 17 at a stop 19 of the press framework 16 in the stamping position P. The stop 19 can be configured, e.g. as ring step coaxially to the working axis A or in another arbitrary manner. Due to the biasing force of the biasing device 18, the second stamping tool 15 and according to the example, the tool carrier 17 is pressed in stroke direction H against the stop 19. In the stamping position P the second stamping tool 15 cannot move further in stroke direction H along the working axis A. A stamping force applied by the ram 11 and the first stamping tool 13 on the round blank 14 is thus supported via the second stamping tool 15 at the press framework 16. The round blank 14 can be deformed for stamping.

The biasing device 18 can be formed by one or more springs. In doing so, helical springs and/or cup springs can be used for example. In FIGS. 1-4 two helical springs are schematically illustrated that form the biasing device 18. The number of springs of biasing device 18 can vary. The helical springs allow a sufficient stroke path of the second stamping tool 15 between the stamping position P and the ejecting position E.

In addition, the stamping press 10 comprises a stamping ring 22 for deformation of the round blank 14. The stamping ring 22 has a ring opening 23 that is arranged coaxially to the working axis A and that is aligned with the first stamping tool 13 and the second stamping tool 15. In the stamping position P a stamping surface of the second stamping tool 15 is flush with an axial end of the ring opening 23 or is arranged inside the ring opening 23. The first stamping tool 13 can move a round blank 14 from a feed side 24 into the ring opening 23 by movement of the ram 11 by means of the ram drive 12. The ring opening 23 can expand conically toward the feed side 24—that is with view in return stroke direction R. A cylindrical section of the ring opening 23, the cross-sectional geometry of which corresponds to the geometry of the stamped round blank 14 to be manufactured and that can be circular or polygonal, adjoins the conical section that is adjacent to the feed side 24.

The yet not stamped round blanks 14 are conveyed in the stamping press 10 adjacent to the feed side 24 by means of a conveying device 25 and the stamped round blanks 14 are conveyed out of the stamping press 10 by means of the conveying device 25. In FIGS. 1-4 only a rotary table 26 with table cavity 27 is schematically illustrated as part of the conveying device 25. The rotary table 26 is rotatable about a rotation axis that is preferably orientated parallel to the working axis A. It can comprise multiple table cavities 27 for one round blank 14 respectively that are distributed in circumferential direction about its rotation axis. The rotary table 26 is advanced intermittently or in a clocked manner such that a round blank that is to be stamped is substantially coaxial with the working axis A and thus is aligned with the stamping tools 13, 15. After stamping the stamped round blank 14 is ejected back into the table cavity 27 and can be conveyed out of the stamping press 10 by the rotary table 26 in the next rotation clock. During this removal of a stamped round blank 14 the next round blank 14 that is to be stamped is conveyed concurrently.

The stamping press 10 has an ejector device 30 with an ejector pin 31 that is supported at an actuating device 32 according to the example. The actuating device 32 is movably coupled with the ram 11 via a connection device 33. The moving connection between ram 11 and the actuating device 32 is transmission ratio free according to the example. As an alternative to this a transmission ratio between the movement of ram 11 and the movement of the ejector pin 31 can be provided. In each case the stroke movement of ram 11 in stroke direction H as well as in return stroke direction R causes a movement of the actuating device 32. For example, the actuating device 32 can be connected with ram 11 by means of at least one draw bar or connection rod 34.

In one embodiment of the stamping press 10 according to FIGS. 1-9 the connection device 33 comprises only one single connection rod 34 for transmission of the ram movement to the actuating device 32.

The at least one or exactly one connection rod 34 can comprise an adjustment device 35 at one location respectively in order to adjust the length of the connection rod 34 (FIG. 5). For example, the adjustment device 35 can be configured by a threaded connection of multiple rod parts of each connection rod 34.

A lever arrangement 80 is part of the actuating device 32 in the embodiments according to FIGS. 1-9. The lever arrangement 80 comprises a first lever 81 as well as a second lever 82 that are connected with each other at a hinge location 83 in a hinged manner. The first lever 81 is supported at a first support location 84 on the press framework 16 in a hinged manner. The first lever 81 is able to pivot about the first support location 84 in a plane that is spanned by the stroke direction H or the return stroke direction R as well as a transverse direction Q. The transverse direction Q is orientated orthogonal to the return stroke direction R or the stroke direction H. In transverse direction Q the hinge location 83 has a first distance s1 from the first support location 84, if the actuating device 32 is in an initial position, in which the second stamping tool 15 takes the stamping position P, the first stamping tool 13 is in contact with the round blank 14 and the ram 11 is substantially at a reversal point of its stroke movement (FIG. 1).

The second lever 82 is supported at a second support location 85 on the press framework 16 via an overload safety device 48. In this embodiment of the overload safety device 48 a fluid chamber 41 is provided inside a housing 40. In the embodiment according to FIGS. 1-9, housing 40 is deformable and according to the example formed by a bellows. The housing 40 can also be configured by any other appropriate unit that allows to change the dimension and/or the shape of the fluid chamber 41. For example, the fluid chamber 41 could also be limited by a movable piston 42 as it is the case in the embodiment according to FIGS. 8-13.

Figure 6:
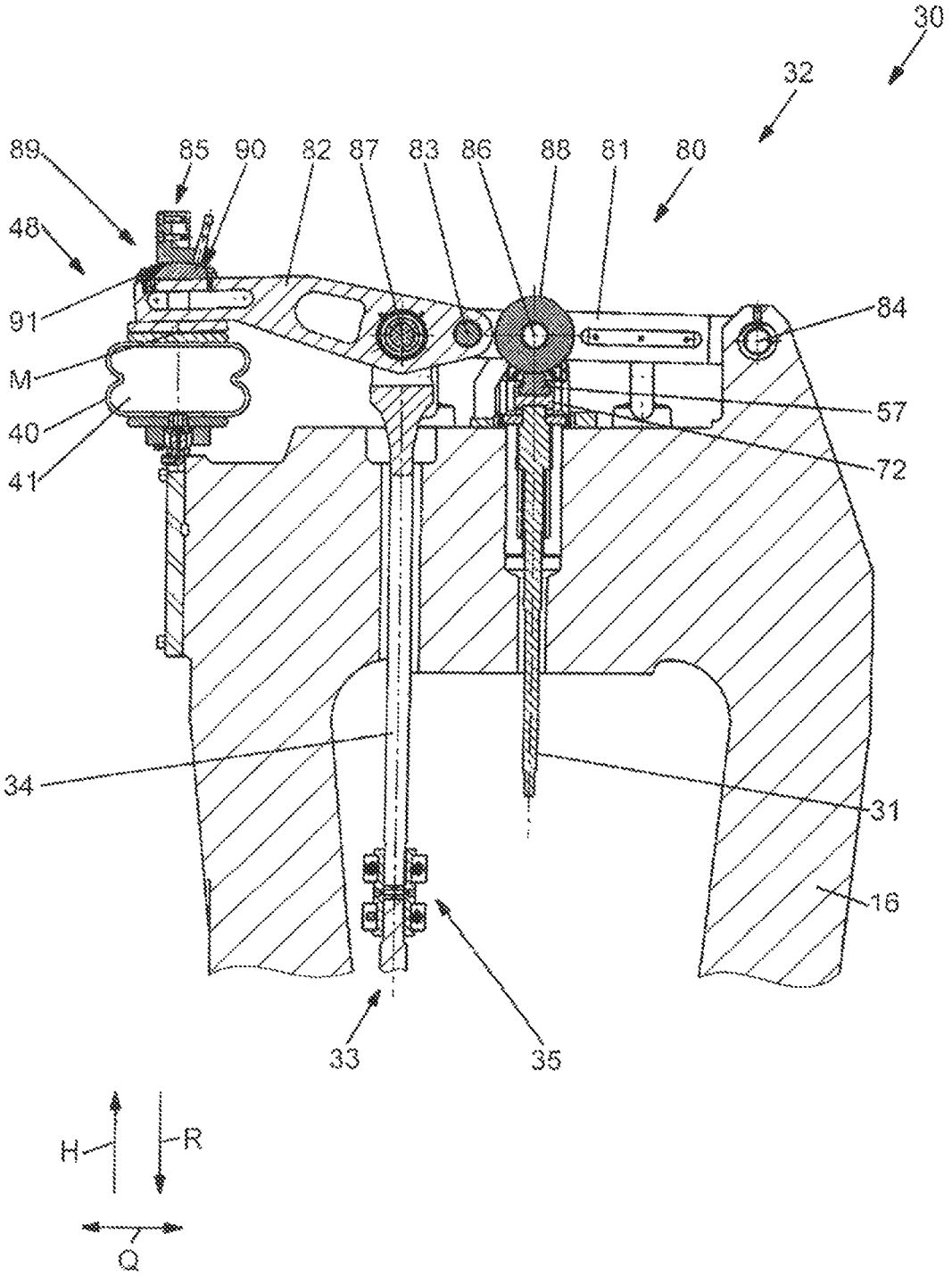

Because the distance between the first support location 84 and the second support location 85 in transverse direction Q must be changeable depending from the relative position of the two levers 81, 82. A roller bearing 89 is provided between the overload safety device 48 and the second lever 82, in order to allow a shifting movement of the second lever 82 in transverse direction Q relative to the overload safety device 48. The second lever 82 has a radially curved abutment surface 90 that abuts a counter abutment surface 91 and that rolls on the counter abutment surface 91 in case of a pivot movement of the second lever 82. The counter abutment surface 91 serves to support the second lever 82, if the overload safety device 48 has not tripped. In case of a non-tripped overload safety device (FIGS. 1, 2 and 4-6), the overload safety device 48 urges or pushes the abutment surface 90 against the counter abutment surface 91. The rolling circle center M is below the abutment surface 90 according to the example (FIG. 6). The second lever 82 can be immovably connected, e.g. screwed, with the housing 40 formed as bellows. The bellows is flexible and thus does not block a pivot and transverse movement of the second lever 82.

As it is schematically illustrated by the arrow in FIGS. 1-4, the fluid chamber 41 can be connected to a controlled or feedback controlled pressure source that controls or feedback controls the gas pressure or air pressure in the fluid chamber 41 according to the targets.

In the first embodiment a compressible gas and particularly air is enclosed in the fluid chamber 41. The housing 40 surrounding the fluid chamber 41 is arranged between the second support location 85 and the press framework 16. The second support location 85 has a second distance s2 from the hinge location 83 in transverse direction Q. In the embodiment the first distance s1 and the second distance s2 are equal. Thus, starting from the hinge connection 83 the first support location 84 and the second support location 85 are arranged on opposite sides relative to the hinge location 83.

The first lever 81 has first coupling location 86 and the second lever 82 has a second coupling location 87. At the first coupling location 86 the ejector pin 31 is supported indirectly or, as an alternative to the illustrated embodiment, directly on the first lever 81. The connection rod 34 engages at the second coupling location 87 of the second lever 82. At this point it should be indicated that the connection rod is only schematically illustrated with one or more kink locations in FIGS. 1-4. Preferably the connection rod 34 extends straight parallel to the stroke direction H or the return stroke direction R.

The first coupling location 86 has a third distance s3 from the hinge location 83 and the second coupling location 87 has a fourth distance s4 from the hinge location 83. Preferably the third distance s3 and the fourth distance s4 are equal.

In the embodiment a roller 88 is arranged at the first coupling location 86 on the first lever 81 that is supported indirectly or directly at the ejector pin 31. The roller 88 is preferably rotatably supported at the first lever 81 such that in case of a pivot movement of the first lever 81 about the first support location, a roller movement of the roller 88 can occur at a component in abutment therewith.

A first spring device 49 is supported on one side at the press framework 16 and on the other side at the ejector pin 31, e.g. at a ring shoulder. The first spring device 49 urges the ejector pin 31 away from the second stamping tool 15.

According to the example, a coupling device 55 is present between the ejector pin 31 and the lever arrangement 80. The coupling device 55 can be switched between a coupling position K (FIGS. 1-3) and a decoupling position D (FIG. 4). In the coupling position K a movement of the actuating device 32 in return stroke direction R is transmitted to the ejector pin 31. In doing so, the ejector pin 31 can move the second stamping tool 15 out of the stamping position P in the ejecting position E, provided that the overload safety device 48 has not tripped due to an overload condition. In the decoupling position D (FIG. 4) a movement of the actuating device 32 and according to the example the lever arrangement 80 in return stroke direction R does not lead to a displacement of the ejector pin 31, whereby the stamping tool 15 remains in its stamping position P (FIG. 4).

In the embodiment described here the coupling device 55 comprises a first coupling part 56 and a second coupling part 57. At least one of the two coupling parts 56, 57 and according to the example the second coupling part 57 is movable and according to the example linearly movable. The second coupling part 57 can be moved orthogonal or obliquely to the working axis A by means of a coupling drive 58 of the coupling device 55. The coupling drive 58 can be formed by a linear motor. According to the example, the second coupling part is shiftably arranged in a guided manner in a guiderail 72 (FIG. 6).

The two coupling parts 56, 57 have a and preferably multiple projections 59 extending parallel to the working axis A. According to the example, each coupling part 56, 57 comprises at least two or three of such projections 59. The projections 59 are arranged with distance to each other under formation of an interstice 60 in a direction, in which the second coupling part 57 is movable by means of the coupling drive 58. The interstice 60 is dimensioned such that a projection 59 of the respective other coupling part can engage in case of a stroke movement of the actuating device 32 without transmitting a force between the two coupling parts 56, 57 in return stroke direction R. In the decoupling position D the projections 59 are offset transverse to the working axis A and do not get into contact (FIG. 4). In the coupling position K the projections 59 are aligned with each other in stroke direction H or return stroke direction R such that they are in contact with each other with their faces such that a movement of the actuating device 32 can cause a movement of the ejector pin 31.

Figure 7:
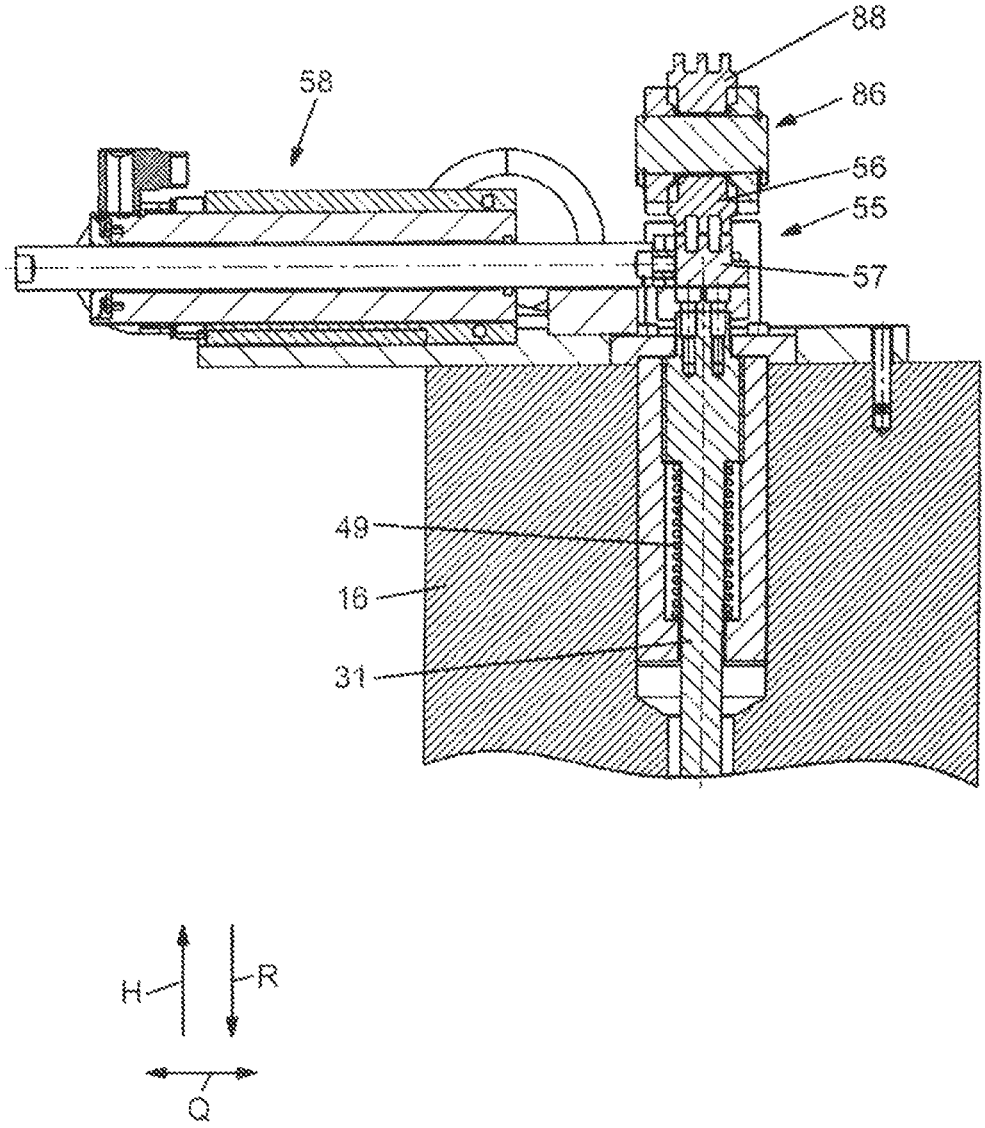
Figure 8:
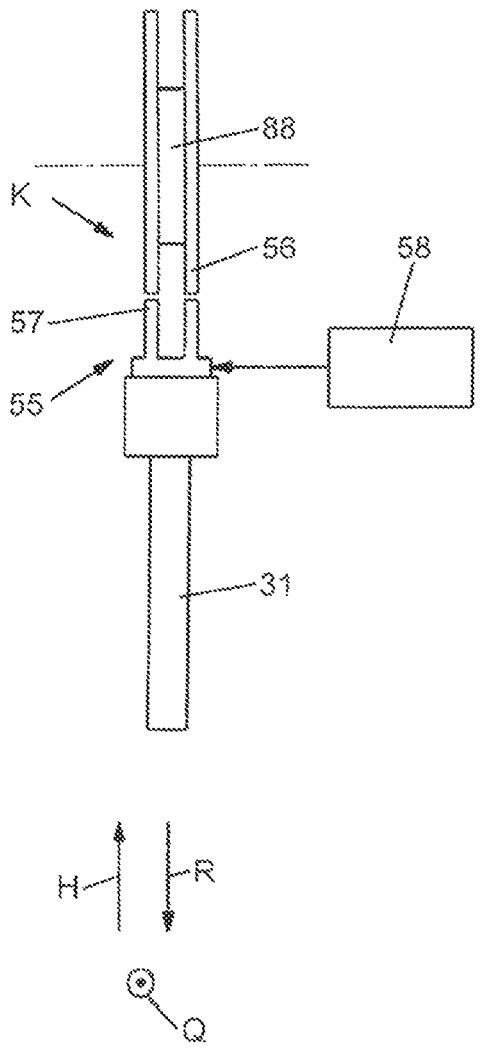
Figure 9:
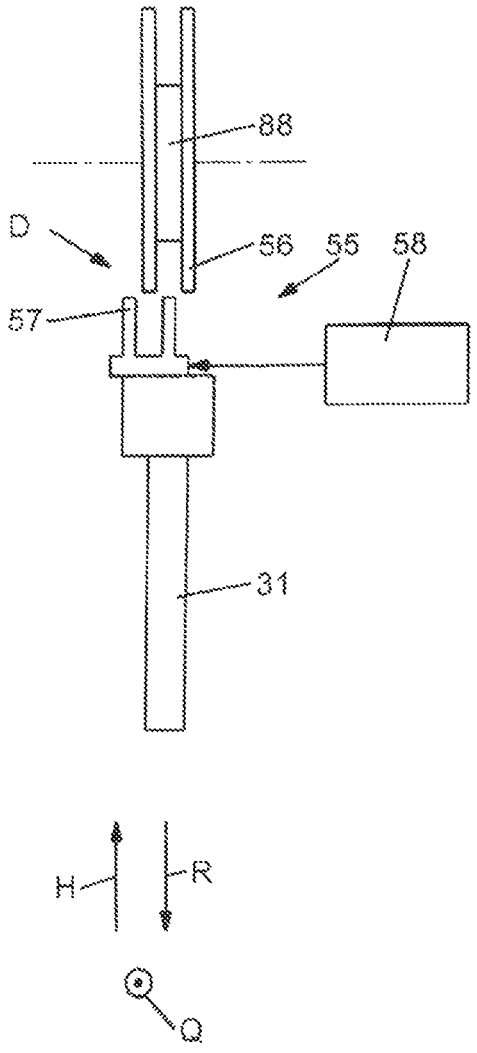

In an embodiment the first coupling part 56 with roller 88 is configured as a unit (FIGS. 7-9). Thus, the roller 88 forms a comb roller. In this embodiment the shifting of the second coupling part 57 is carried out parallel to the rotation axis of the roller 88.

As an alternative to this, the first coupling part 56 can also be configured separately from the roller 88 and can be indirectly or directly in contact with roller 88. Both possibilities (coupling part 56 can be configured separately from roller 88 or as a unit) are illustrated in FIGS. 1-4 by double arrow between roller 88 and the first coupling part 56. The separate first coupling part 56 can abut at the roller 88 indirectly or directly. According to the example, the first coupling part 56 can be supported at the press framework 16 via a second spring device 62 (that is only illustrated in FIG. 1 for sake of clarity). A second spring device 62 urges the first coupling part 56 away from the second coupling part 57 in direction toward the lever arrangement 80.

The number of projections 59 and interstices 60 can vary, wherein preferably at least two or three projections 59 are provided at each coupling part 56, 57.

The embodiments of the stamping press 10 according to FIGS. 1-9 operate as follows:

At the beginning of the method a new round blank 14 that is to be stamped is conveyed between the two stamping tools 13, 15. Subsequently the ram drive 12 initiates a movement of the ram 11 with the first stamping tool 13 in stroke direction H toward the second stamping tool 15. In doing so, the first stamping tool 13 carries the round blank 14 arranged in the table cavity 27 of the rotary table 26 and moves the round blank 14 into the ring opening 23. The actuating device 32 and particularly the lever arrangement 80 moves in stroke direction H concurrently with the ram 11 such that pressing of the round blank 14 against the second stamping tool 15 occurs only at a point of time at which the stamping tool 15 has taken the stamping position P (FIG. 1). The force applied by the ram drive 12 via ram 11 and the first stamping tool 13 deforms the round blank 14 between the two stamping tools 13, 15 within the stamping ring 22.

After stamping the ram 11 moves back in return stroke direction R. In doing so, the actuating device 32 and according to the example the lever arrangement 80 is actuated via the connection device 33. If the coupling device 55 is in the coupling position K, the movement of ram 11 is transmitted via the lever arrangement 80 onto the ejector pin 31. The ejector pin 31 then also moves in return stroke direction R and engages the second stamping tool 15 that as a result moves out of a stamping position P in the ejecting position E (FIG. 2). In this ejecting position E the second stamping tool 15 pushes the stamped round blank 14 out of the ring opening 23 back into the table cavity 27 of the rotary table 26.

Due to a subsequent conveying movement of the rotary table 26, the stamped round blank 14 is removed out of the stamping press 10 and a new round blank 14 that is to be stamped or an unmachined round blank that is to be stamped is conveyed. Subsequently, the stamping process as described above starts again.

FIG. 4 illustrates the coupling device 55 in the decoupling position D. Indeed the movement of ram 11 is transmitted on the lever arrangement 80, however, lever arrangement 80 and according to the example the first lever 81 is unable to transmit its movement on the ejector pin 31. The two coupling parts 56, 57 are mechanically decoupled and the movement in return stroke direction R transmitted from the first lever 81 to the first coupling part 56 is not transmitted to the second coupling part 57 such that the ejector pin 31 does not engage the second stamping tool 15 and the second stamping tool 15 remains in the stamping position P. The round blank 14 partly stamped during the first stroke of the ram 11 remains in the stamping ring 22. During deformation the round blank 14 expands in radial direction and is retained in a force fit or friction fit manner inside the ring opening 23. In the decoupling position D of the coupling device 55 the ram with the first stamping tool 13 can execute multiple stamping strokes on the same round blank 14. After the round blank 14 is completely stamped the coupling device 55 is again switched in the coupling position K such that during the next return stroke of the ram 11 in return stroke direction R an ejection of the stamped round blank 14 can be carried out.

As is illustrated in FIG. 1, a gap or play can be provided between the two coupling parts 56, 57, if the second stamping tool 15 is in the stamping position and if substantially no force is effective between the ejector pin 31 and the second stamping tool. In doing so, a switching between the coupling position K and the decoupling position D (in both directions) is improved.

The progress described above refers to stamping without overload condition. FIG. 3 schematically shows the occurrence of an overload condition. If the force that is applied via the lever arrangement 80 or the actuating device 32 on the ejector pin 31 reaches a threshold, this force is limited by the overload safety device 48. In the embodiments according to FIGS. 1-9, the air present in the fluid chamber 41 is compressed. Thereby the first lever 81 forms a fixed bearing at the first coupling location 86 so-to-speak. Because the force via the ejector pin 31 becomes too large, the first lever 81 is supported at the first coupling location 86 and its pivot movement about the first support location 84 is blocked so-to-speak. Because the ram 11 continues moving in return stroke direction R, the second lever 82 is moved at the second support location 85 and compresses the air in the fluid chamber 41. In doing so, the force applied via the lever arrangement 80 on the ejector pin 31 is limited.

In FIGS. 10-16 another embodiment of the stamping press 10 or the ejector device 30 is illustrated. Subsequently, only differences between the above-explained embodiments are described.

Different to the preceding embodiment, the overload safety device 48 is configured as hydraulic overload safety device 48 in the second embodiment. The housing 40 with the fluid chamber 41 is limited on one side by a movable piston 42 that closes the fluid chamber 41 in a fluid-tight manner. The fluid chamber 41 is fluidically connected with a reservoir 45 via a safety line 43 in which a safety valve 44 is arranged.

The reservoir 45 is fluidically connected with the fluid chamber 41 via a supply line 46. A pump 47 is arranged in the supply line 46. According to the example, a hydraulic liquid serves as fluid. The transmission oil of the stamping press 10 can be used as hydraulic fluid. The fluid chamber 41 is filled with hydraulic liquid in case of an undisturbed operation. If the fluid pressure in the fluid chamber 41 exceeds a threshold, the safety valve 44 opens and the safety line 43 connects the fluid chamber 41 with the reservoir 45 such that fluid can flow out of the fluid chamber 41 in the reservoir 45. The reservoir 45 can be a substantially pressure-free storage tank. At least the pressure in the reservoir 45 is less than in the fluid chamber 41. The safety valve 44 that is fluidically connected with the fluid chamber 41 thus forms an overload safety device 48.

In this embodiment the housing 40 is immovably arranged at the connection device 33 or movably coupled with the connection rod 34. In this embodiment the first spring device 49 is supported on one side indirectly (or alternatively also directly) at the ejector pin 31 and on the other side at the piston 42. In this embodiment the first spring device 49 is preferably formed by a cup spring arrangement with cup springs 50. Different to the preceding embodiment, the first coupling part 56 is supported via the second spring device 62 that comprises at least one spring 63 on a support part 64 of the housing 40. The second spring device 62 urges the first coupling part 56 away from the second coupling part 57 in stroke direction H.

Figure 11:
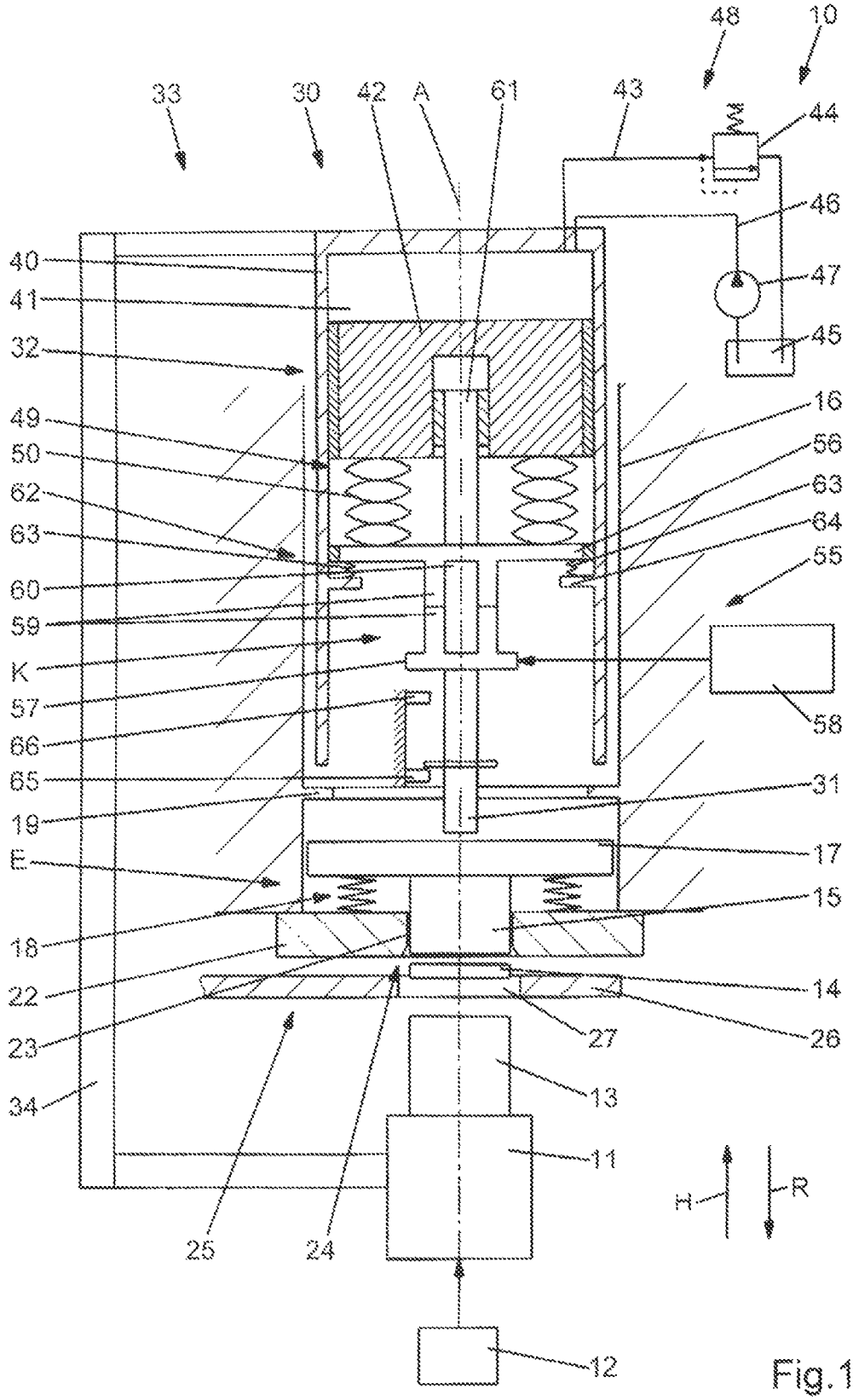

The end of the ejector pin 31 opposite the second coupling part 57 is assigned to the second stamping tool 15 and according to the example, to the tool carrier 17 and is in contact therewith, if a stamped round blank 14 is ejected from the stamping ring 22 (FIG. 11).

In principle, the stamping press 10 according to FIGS. 10-16 operates during normal operation just like the first embodiment according to FIGS. 1-9. If the stamping tool 15 is in the ejecting position E, the first spring device 49 (according to the example, the cup springs 50) can be elastically compressed. The ejector pin 31 can abut against a lower stop 65 (FIG. 11). If in this position a slight stroke movement of ram 11 is carried out in return stroke direction R, this slight movement of ram 11 is compensated by compressing of the first spring device 49. The ejector pin 31 continuously engages the stamping tool 15 and this remains in its ejecting position E.

Figure 10:
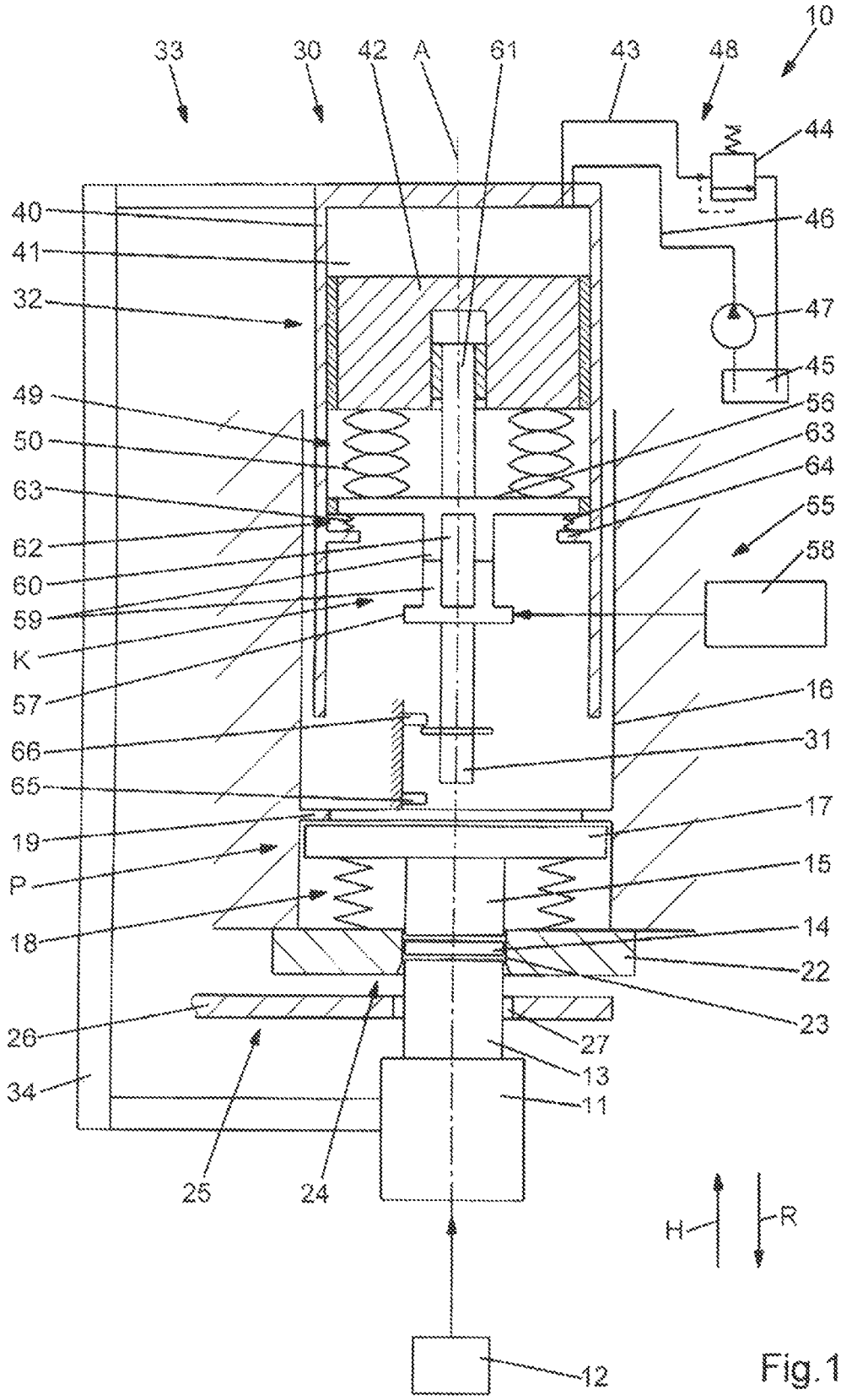

In the position shown in FIG. 10 the ejector pin 31 can abut against an upper stop 66. Thus, the ejector pin 31 can move between a retracted position at the upper stop 66 and an extended position at the lower stop 65. In the extended position the stamping tool 15 is in the ejecting position E and in the retracted position the stamping tool 15 is in the stamping position P. The lower stop 65 and the upper stop 66 are only illustrated highly schematically in FIGS. 10, 11 and are omitted in FIGS. 12 and 13 for sake of clarity.

Figure 12:
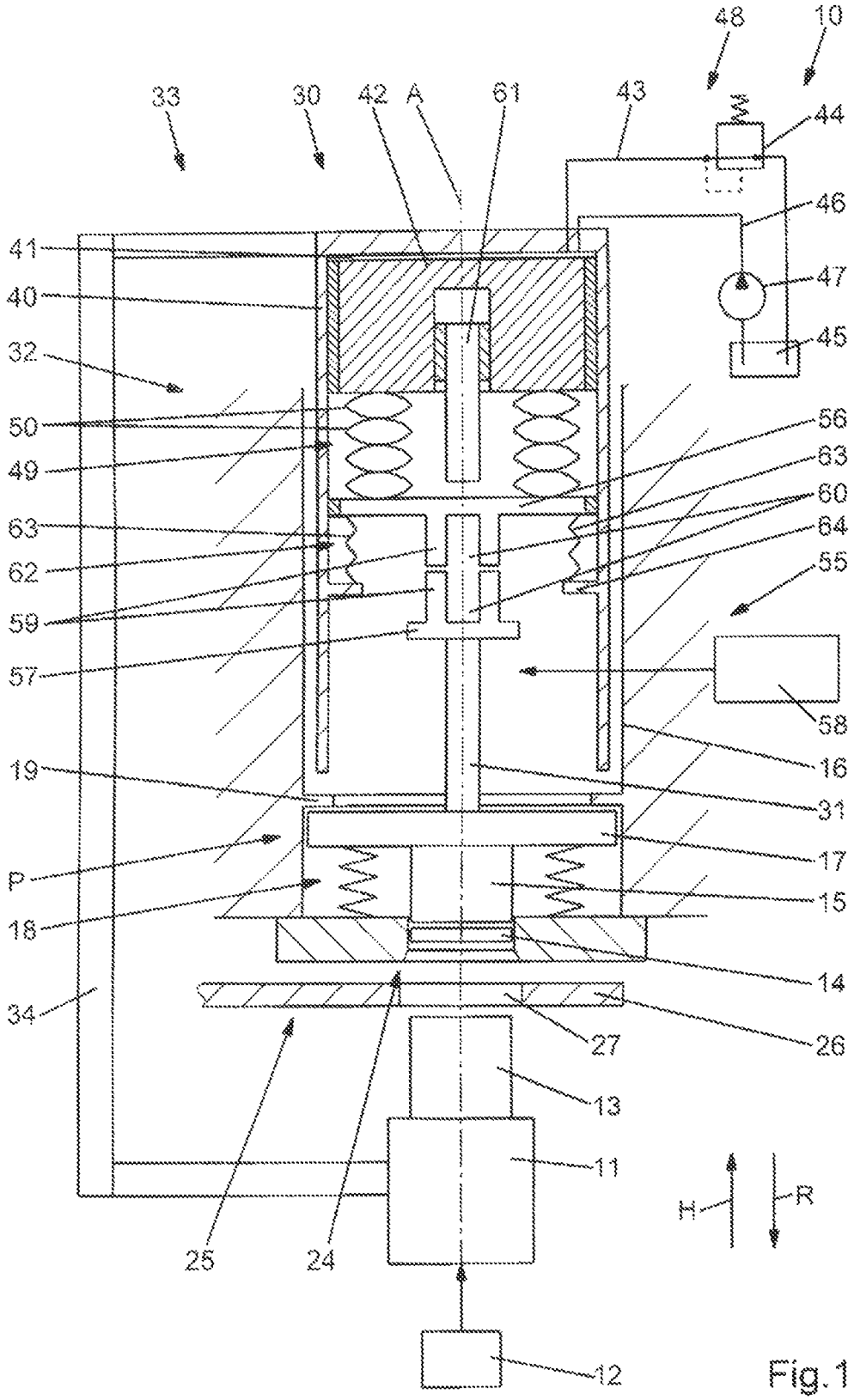
Figure 13:
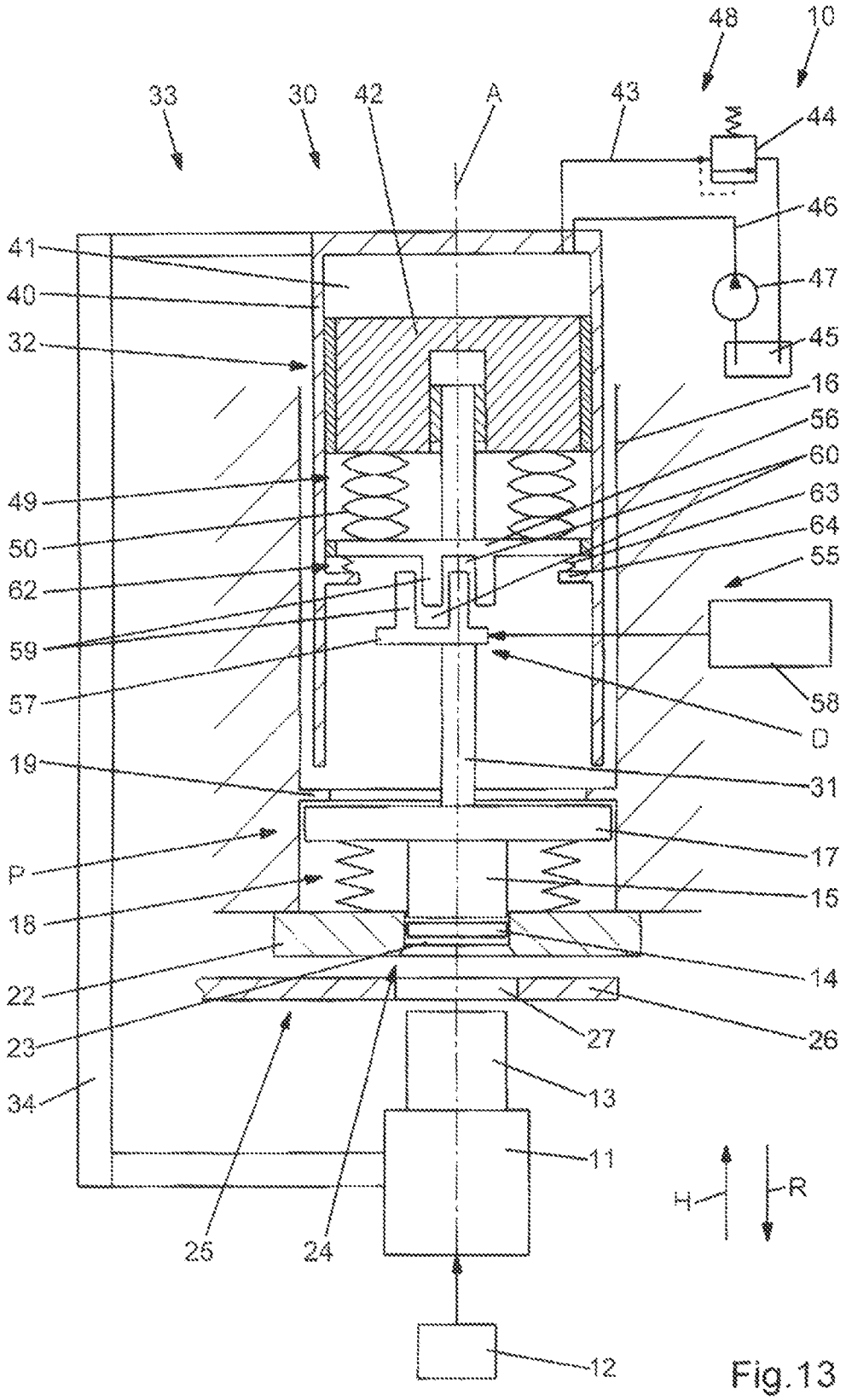

In FIG. 12 the stamping press 10 is shown in case of the occurrence of an overload condition. If the force on the piston 42 transferred via the ejector pin 31, the coupling device 55 and the connection bolt 61 becomes too large, the fluid pressure in fluid chamber 41 exceeds a pressure threshold defines by the safety valve 44. As a result the safety valve 44 is switched from its blocking position (FIGS. 10, 11 and 13) into its open position (FIG. 12) and the fluid chamber 41 is fluidically connected with the reservoir 45. Because the pressure in fluid chamber 41 is higher, the fluid suddenly flows out of the fluid chamber 41 into the reservoir 45. Also the fluid is urged out of the fluid chamber by support of the first spring device 49. As a consequence the stroke movement of the actuating device 32 does not lead to a force transmission of the coupling parts 56, 57 and thus to a movement of the ejector pin 31. The force flow is interrupted due to the substantially pressureless fluid chamber 41. The biasing device 18 urges the second stamping tool 15 in the stamping position P that remains there. Such an overload case can occur, if the round blank 14 is clamped in the ring opening 23 and cannot be moved out of the ring opening 23 with the usually required forces. By means of the overload safety device 48, the stamping press 10 is protected from damages.

Figure 14:
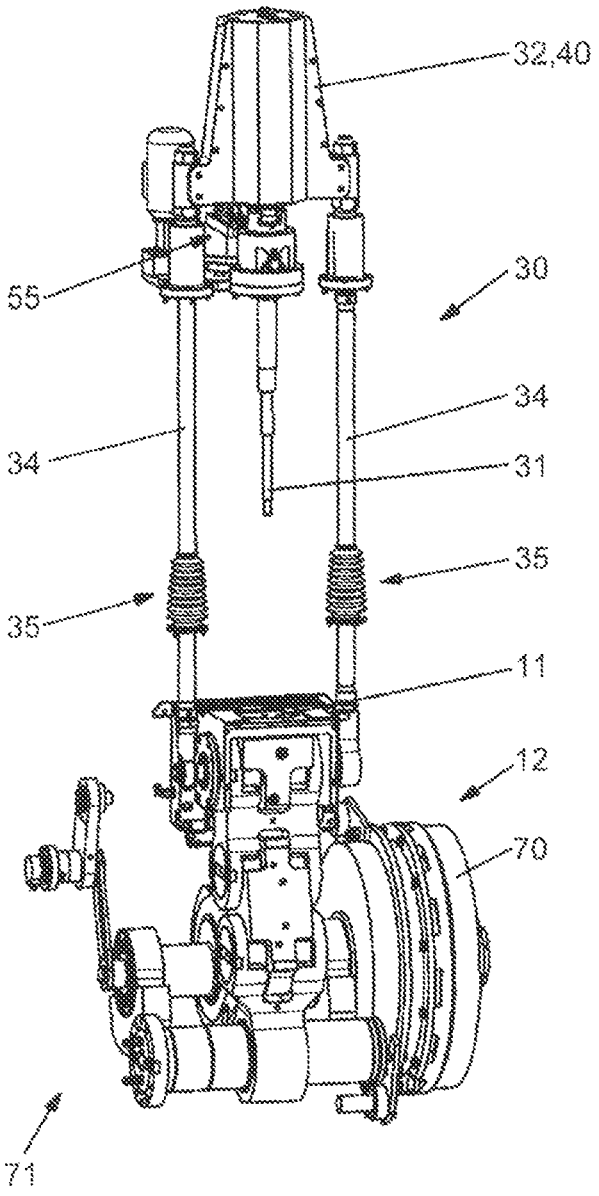

FIG. 14 illustrates the ram drive 12 and the ejector device 30 in a perspective view. The ram drive 12 has a flywheel 70 that can be driven by a non-illustrated drive motor. The flywheel 70 is connected via a transmission 71 with ram 11. The transmission 71 can be configured as eccentric transmission and/or elbow lever transmission.

Figure 15:
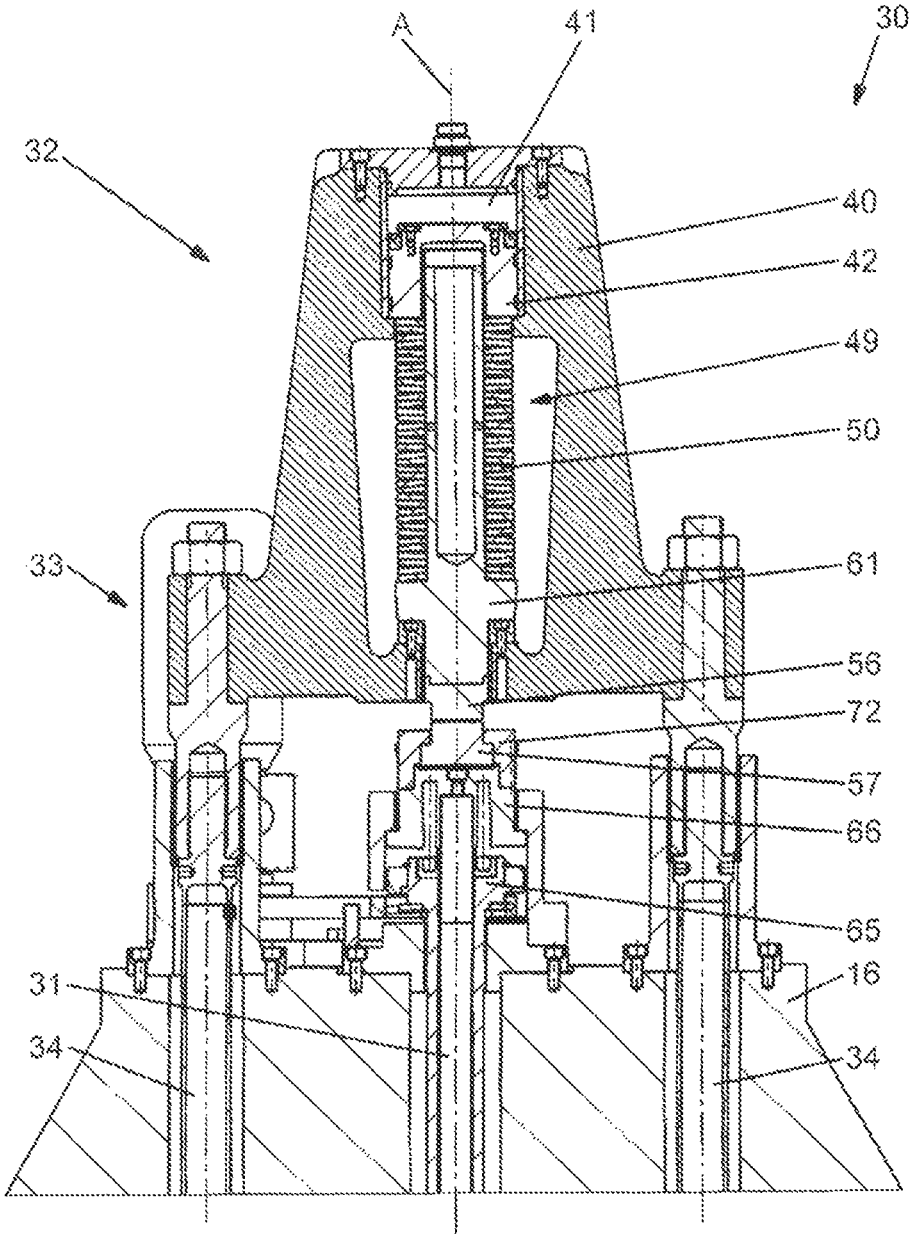
Figure 16:
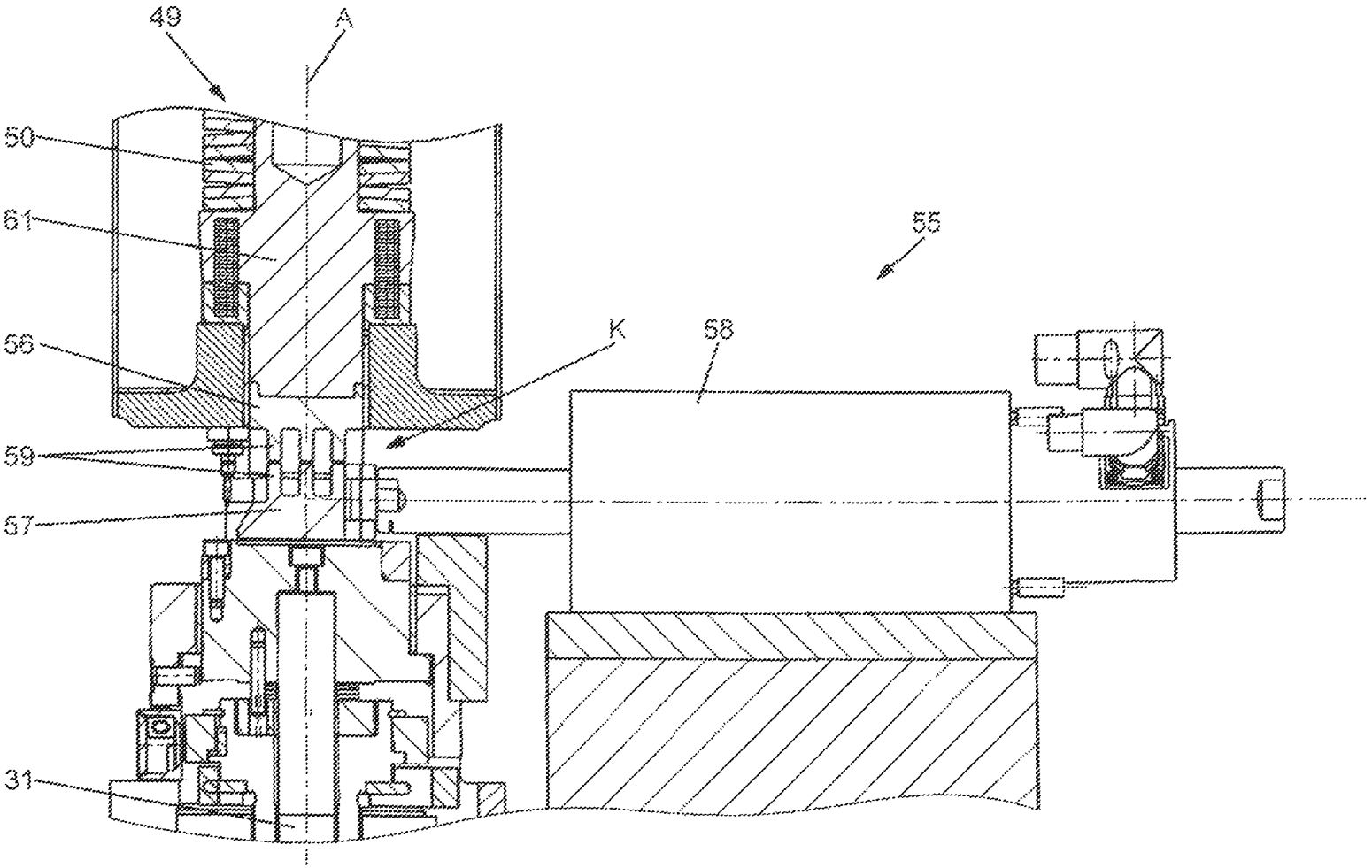

As is apparent in FIGS. 15 and 16, the cup springs 50 of the first spring device 49 are arranged coaxially to the working axis A about a connection bolt 71 according to the example. The connection bolt couples the first coupling part 56 with the piston 42 according to the example.

The second coupling part 57 is preferably linearly supported in a guided manner in the direction in which it can be moved by the coupling drive 58. Analog to the embodiment described previously (FIGS. 1-9), the second coupling part 57 is shiftably arranged in the guide rail 72 (FIGS. 6 and 15). The second coupling part 57 can be denoted as a comb slide and the first coupling part 56 can be denoted as a counter comb.

In both embodiments the coupling drive 58 can comprise a linear motor that is able to move the second coupling part 57 very fast transverse to the working axis A and thus transverse to the stroke direction H or return stroke direction R. As shown in FIGS. 7 and 16, the coupling drive 58 configured as an electric linear motor is immovably arranged and does not move commonly with the housing 40 in stroke direction H or return stroke direction R. This relative movement in stroke direction H or return stroke direction R can be realized by a respective connection unit of a drive part (e.g. piston rod) of the linear motor 58 with the second coupling part 57. This connection unit can comprise two connection elements that can be shifted parallel to the working axis A and that are only commonly movable radial to the working axis A. For example the one connection element can be a sliding block that is only shiftable in a guided manner in one degree of freedom in a groove of the other connection element parallel to the working axis A. The one connection element is connected with the linear drive 58 and the other connection element is rigidly connected with the second coupling part 57.

The invention refers to a stamping press for stamping a round blank 14. A ram 11 movable in a stroke direction H and opposite to the stroke direction H in a return stroke direction R carries a first stamping tool 13. A second stamping tool 15 is supported on a press framework 16. In addition, a stamping ring 2 is arranged on the press framework 16. The stamping tools 13, 15 and a stamping opening 23 formed by the stamping ring 22 are arranged aligned along a working axis A. An ejector device 30 serves to eject a stamped round blank 14 from the ring opening 23 of the stamping ring 22. It comprises an ejector pin 31 that is supported on an actuating device 32. The actuating device 32 is movably coupled with ram 11. During a return stroke of ram 11 in return stroke direction R the ejector pin 31 can be supported at the actuating device 32 and apply a force on the second stamping tool 15 in return stroke direction R in order to press the round blank 14 out of the stamping ring 22. During a movement of the ram 11 in stroke direction H the actuating device 32 departs from second stamping tool 15 such that the ejector pin 31 does not apply a force in return stroke direction R on the second stamping tool 15 and the second stamping tool 15 can take the stamping position P.

LIST OF REFERENCE SIGNS

10 stamping press
11 ram
12 ram drive
13 first stamping tool
14 round blank
15 second stamping tool
16 press framework
17 tool carrier
18 biasing device
19 stop
22 stamping ring
23 ring opening
24 feed side
25 conveying direction
26 rotary table
27 table cavity
30 ejector device
31 ejector pin
32 actuating device
33 connection device
34 connection rod
35 adjustment device
40 housing
41 fluid chamber
42 piston
43 safety line
44 safety valve
45 reservoir
46 supply line
47 pump
48 overload safety device
49 first spring device
50 cup spring
55 coupling device
56 first coupling part
57 second coupling part
58 coupling drive
59 projection
60 interstice
61 connection bolt
62 second spring device
63 spring
64 support part
65 lower stop
70 flywheel
71 transmission
72 guide rail
80 lever arrangement
81 first lever
82 second lever
83 hinge location
84 first support location
85 second support location
86 first coupling location
87 second coupling location
88 roller
89 roller bearing
90 abutment surface
91 counter abutment surface
A working axis
D decoupling position
E ejecting position
H stroke direction
K coupling position
M rolling circle center
P stamping position
R return stroke direction
s1 first distance
s2 second distance
s3 third distance
s4 fourth distance

What is claimed is:

1. Stamping press (10) for stamping a round blank (14) comprising:

a ram (11) that is movable in a stroke direction (H) to a stamping position (P) for stamping the round blank (14) and opposite to the stroke direction (H) in a return stroke direction (R) by means of a rain drive (12);

a first stamping tool (13) that is arranged at the rain (11), having a second stamping tool (15) that is arranged at a press framework (16) and having a stamping ring (22);

an ejector device (30) that comprises an ejector pin (31) that is configured to move the second stamping tool (15) in the return stroke direction (R) out of the stamping position (P) in an ejecting position (E) in order to eject a stamped round blank (14) out of the stamping ring (22), the rain (11) and the ejector pin (31) linearly moveable in operative arrangement along a common working axis (A);

a connection device (33) comprising an actuating device (32) supporting the ejector pin (31) and at least one connection rod (34) that movably couples the rain (11) and the actuating device (32) with each other;

a coupling device (55) is arranged between the actuating device (32) and the ejector pin (31) that is configured to couple the actuating device (32) and the ejector pin (31) in a coupling position (K) in the return stroke direction (R) with each other and to decouple the actuating device (32) and the ejector pin (31) in a decoupling position (D) in the return stroke direction (R) from each other;

the coupling device (55) comprises a first coupling part (56) coupled with the actuating device (32), a second coupling part (57) coupled with the ejector pin (31), the first coupling part (56) and the second coupling part (57) in the coupling position (K) coaxially arranged along the common working axis (A) positioned in direct contacting relationship with each other, the first coupling part (56) and the second coupling part (57) in the decoupling position (D) positioned in non-contacting relationship with each other, and a coupling drive (58) configured to at least move from the coupling position (K) one of the first coupling part (56) and the second coupling part (57) orthogonally or obliquely relative to the common working axis (A) to the decoupling position (D);

wherein in the decoupling position (D) any movement of the actuating device (32) in the return stroke direction (R) does not cause a movement of the ejector pin (31) in the return stroke direction (R); and, wherein the ejector pin (31) does not engage the second stamping tool (15) with a force in the return stroke direction (R) until the second stamping tool (15) has reached the stamping position (P) and the coupling drive (58) at least moves one of the first coupling part (56) and the second coupling part (57) from the decoupling position (D) to the coupling position (K) and the rain (11) is moved in the return stroke direction (R) by means of the rain drive (12) after the round blank (14) has been stamped.

2. Stamping press according to claim 1, characterized in that the actuating device (32) comprises a lever arrangement (80) comprising a first lever (81) and a second lever (82) that are connected with each other at a hinge location (83) in a hinged manner.

3. Stamping press according to claim 2, characterized in that the ejector pin (31) is coupled with the first lever (81) at a first coupling location (86) that comprises a distance (s3) to the hinge location (83) in a transverse direction (Q) orthogonal to the stroke direction (H) and to the return stroke direction (R).

4. Stamping press according to claim 2, characterized in that the connection rod (34) is coupled with the second lever (82) at a second coupling location (87) that has a distance (s4) to the hinge location (83) in a transverse direction (Q) orthogonal to the stroke direction (H) and to the return stroke direction (R).

5. Stamping press according to claim 4, characterized in that the ejector pin (31) is coupled with the first lever (81) at a first coupling location (86) that comprises a distance (s3) to the hinge location (83) in a transverse direction (Q) orthogonal to the stroke direction (H) and to the return stroke direction (R), the distance (s3) between the first coupling location (86) and the hinge location (83) is equal to the distance (s4) between the second coupling location (87) and the hinge location (83).

6. Stamping press according to claim 1, characterized in that the second stamping tool (15) is in contact with a stop (19) of the press framework (16) in stroke direction (H), if in the stamping position (P).

7. Stamping press according to claim 1, characterized in that the second stamping tool (15) is urged in the stamping position (P) by means of a biasing device (18).

8. Stamping press according to claim 1, characterized in that an overload safety device (48) is arranged at the actuating device (32) that limits a force that can be transmitted between the actuating device (32) and the ejector pin (31).

9. Stamping press according to claim 8, characterized in that the overload safety device (48) comprises a fluid chamber (41).

10. Stamping press according to claim 9, characterized in that the fluid chamber (41) is compressible.

11. Stamping press according to claim 8, characterized in that the actuating device (32) comprises a lever arrangement (80) comprising a first lever (81) and a second lever (82) that are connected with each other at a hinge location (83) in a hinged manner, the overload safety device (48) is coupled with the second lever (82).

12. Stamping press according to claim 1, characterized in that the first coupling part (56) in the operative position includes at least one projection (59) facing the second coupling part (57), the at least one projection (59) of the first coupling part (56) in the operative position extending parallel to the common working axis (A), the second coupling part (57) includes at least one projection (59) facing the first coupling part (56), the at least one projection (59) of the second coupling part (57) in the operative position extending parallel to the common working axis (A), the at least one projection (59) of the first coupling part (56) in the decoupling position (D) is offset transverse to the common working axis (A) in non-contacting non-force transmitting relationship with a respective at least one projection (59) of the second coupling part (57), and the at least one projection (59) of the first coupling part (56) in the coupling position (K) is aligned in contacting force-transmitting relationship with a respective at least one projection (59) of the second coupling part (57) in the stroke direction (H) or return stroke direction (R) wherein a movement of the actuating device (32) causes a movement of the ejector pin (31).

13. Stamping press according to claim 1, characterized in that coupling drive (58) comprises a linear motor.

14. Method for stamping a round blank (14) by using a stamping press (10) according to claim 1 comprising the following steps:

Conveying a round blank (14) between the first stamping tool (13) and the second stamping tool (15), Moving the rain in the stroke direction (H), whereby due to the movement coupling of the rain (11) with the ejector pin (31), also the ejector pin (31) moves in the stroke direction (H) and allows a movement of the second stamping tool (15) in the stamping position (P), and moving the round blank (14) into the stamping ring (22) by means of the first stamping tool (13), Pressing the round blank (14) against the second stamping tool (15) only when the second stamping tool (15) is in the stamping position (P), Moving of the rain (11) in the return stroke direction (R) away from the second stamping tool (15), Moving of the ejector pin (31) in the return stroke direction (R), if an ejection of the stamped round blank (14) from the stamping ring (22) shall be carried out due to the movement coupling of the ejector pin (31) with the rain (11).

15. Method according to claim 14, characterized in that after ejection of a stamped round blank (14), another round blank (14) to be stamped is conveyed between the first stamping tool (13) and the second stamping tool (15) and concurrently the stamped round blank (14) is conveyed out of an area between the first stamping tool (13) and the second stamping tool (15).

16. Method according to claim 14, characterized in that the stroke paths of the rain (11) and the ejector pin (31) are equal during a return stroke of rain (11) in the return stroke direction (R), if a stamped round blank (14) is ejected from the stamping ring (22).

* * * * *